US009797638B2

(12) United States Patent
Taguchi

(10) Patent No.: US 9,797,638 B2
(45) Date of Patent: Oct. 24, 2017

(54) COMPRESSOR

(71) Applicant: SANDEN HOLDINGS CORPORATION, Isesaki-shi (JP)

(72) Inventor: Yukihiko Taguchi, Isesaki (JP)

(73) Assignee: SANDEN HOLDINGS CORPORATION, Isesaki-shi (JP)

( * ) Notice: Subject to any disclaimer, the term of this patent is extended or adjusted under 35 U.S.C. 154(b) by 349 days.

(21) Appl. No.: 14/441,118

(22) PCT Filed: Nov. 7, 2013

(86) PCT No.: PCT/JP2013/080161

§ 371 (c)(1),
(2) Date: May 6, 2015

(87) PCT Pub. No.: WO2014/073620

PCT Pub. Date: May 15, 2014

(65) Prior Publication Data

US 2015/0300711 A1 Oct. 22, 2015

(30) Foreign Application Priority Data

Nov. 7, 2012 (JP) ..... 2012-245724

(51) Int. Cl.
*F15B 21/04* (2006.01)
*F25B 43/02* (2006.01)
*F04B 27/10* (2006.01)

(52) U.S. Cl.
CPC ..... *F25B 43/02* (2013.01); *F04B 27/10* (2013.01); *F04B 27/109* (2013.01); *F04B 27/1081* (2013.01)

(58) Field of Classification Search
CPC ..... F04B 27/1081; F04B 27/109; F25B 43/02
See application file for complete search history.

(56) References Cited

U.S. PATENT DOCUMENTS 4,019,342 A * 4/1977 Ohta ..... F04B 27/1081 417/269
4,392,788 A 7/1983 Nakamura et al.
(Continued)

FOREIGN PATENT DOCUMENTS

JP 57-38677 3/1982
JP 4-276192 10/1992
(Continued)

OTHER PUBLICATIONS

Office Action dated Aug. 30, 2016 which issued in the corresponding Japanese Patent Application No. 2012-245724.

*Primary Examiner* — Michael Leslie
(74) *Attorney, Agent, or Firm* — Cozen O'Connor

(57) ABSTRACT

A compressor capable of reducing oil circulation rate with a simple structure is provided. A compressor 100 in which a piston 136 is caused to reciprocate, so that a refrigerant gas drawn from a suction chamber 141 via a suction hole 103*a* is compressed and discharged, includes: a partition member 150 dividing the suction chamber 141, into which the refrigerant gas flows from a suction passage 104*a*, into a first space 141*a* connected to the suction passage 104*a* and a second space 141*b* connected to the suction hole 103*a*; and a communication passage 150*a* configured to allow the first space 141*a* and the second space 141*b* to be in communication with each other, and introduce the refrigerant gas, from which lubricating oil has been separated, from the first space 141*a* to the second space 141*b*.

6 Claims, 8 Drawing Sheets

(56) References Cited

U.S. PATENT DOCUMENTS

| | | | | |
|---|---|---|---|---|
| 5,580,224 | A * | 12/1996 | Ikeda | F04B 27/109 417/269 |
| 6,558,133 | B2 * | 5/2003 | Fukanuma | F04B 27/109 417/222.2 |
| 2002/0172602 | A1 | 11/2002 | Fukanuma et al. | |
| 2013/0259714 | A1 * | 10/2013 | Taguchi | F04B 27/1036 417/274 |

FOREIGN PATENT DOCUMENTS

| | | |
|---|---|---|
| JP | 96473/1993 | 12/1993 |
| JP | 2002-213350 | 7/2002 |
| JP | 2006-77737 | 3/2006 |
| JP | 2012-127233 | 7/2012 |
| WO | WO 2007/111194 | 10/2007 |

* cited by examiner

COMPRESSOR

RELATED APPLICATIONS

This is a U.S. National Phase Application under 35 USC 371 of International Application PCT/JP2013/080161 filed on Nov. 7, 2013.

This application claims the priority of Japanese application no. 2012-245724 Nov. 7, 2012, the entire content of which is hereby incorporated by reference.

TECHNICAL FIELD

The present invention relates to a compressor for compressing refrigerant gas including lubricating oil, and more particularly, relates to a technique for reducing the amount of lubricating oil flowing out from the compressor to an external refrigerant circuit.

BACKGROUND ART

In a conventional compressor for use in a vehicle air conditioner system, lubricating oil is mixed with refrigerant gas, and components and the like of the compressor in a crank chamber are lubricated thereby. In this case, when the lubricating oil flows out to an external refrigerant circuit for heat exchange, the efficiency of the system is reduced. Therefore, it is desired to reduce the amount of lubricating oil flowing out from the compressor to the external refrigerant circuit, and more specifically, it is desired to reduce an oil circulation rate (OCR).

For this reason, for example, in a compressor disclosed in Patent Document 1, a centrifugal separation-type oil separator is provided in a discharge passage extending from a discharge chamber, so as to separate lubricating oil, to thereby reduce the amount of the lubricating oil flowing out of the discharge passage, and thus, the OCR can be reduced. In a compressor disclosed in Patent Document 2, a centrifugal separation-type oil separator is provided in a passage that allows a crank chamber and a suction chamber to be in communication with each other, so as to separate lubricating oil, to thereby cause the lubricating oil to return to the crank chamber. This reduces the amount of the lubricating oil flowing out from the crank chamber to the suction chamber, and thus, the OCR can be reduced.

REFERENCE DOCUMENT LIST

Patent Documents

Patent Document 1: Publication of Japanese Translation of PCT Application No. 2007/111194

Patent Document 2: Japanese Patent Application Laid-open Publication No. 2002-213350

SUMMARY OF THE INVENTION

Problems to be Solved by the Invention

However, in the compressor disclosed in Patent Document 1, the centrifugal separation-type oil separator is required to be provided in the discharge passage, and in addition, a storage chamber for storing separated oil is required to be provided separately, and this makes the structure complicated.

In the compressor disclosed in Patent Document 2, since the centrifugal separation-type oil separator is configured to be provided in the passage that allows the crank chamber and the suction chamber to be in communication with each other, the structure becomes complicated.

The present invention was made in view of such circumstances, and in particular, it is an object of the present invention to provide a compressor capable of reducing the OCR with a simple structure.

Means for Solving the Problems

In order to achieve the above object, a compressor according to the present invention is a compressor in which a piston is caused to reciprocate, so that a refrigerant gas drawn from a suction chamber via a suction hole is compressed and discharged, the compressor including: a partition member that divides the suction chamber, into which the refrigerant gas flows from a suction passage, into a first space connected to the suction passage and a second space connected to the suction hole; and a communication passage configured to allow the first space and the second space to be in communication with each other, and introduce the refrigerant gas, from which lubricating oil has been separated, from the first space to the second space.

Effects of the Invention

According to the compressor of the present invention, the partition member divides the suction chamber into the first space and the second space. The suction passage is connected to the first space, and the suction hole is connected to the second space. The refrigerant gas, from which the lubricating oil has been separated, is introduced from the first space to the second space directly connected to the suction hole via the communication passage. Therefore, the refrigerant gas from which the lubricating oil has been separated can be compressed and discharged.

In this manner, since the lubricating oil can be separated by using the first space, which is a portion of the suction chamber, this can reduce the amount of the lubricating oil flowing out to the external refrigerant circuit, and reduce the OCR, with a simple structure.

In addition, since the lubricating oil flowing out from the crank chamber is separated and stored in the first space, no excessive lubricating oil remains in the crank chamber, and this can reduce a decrease in oil viscosity during high speed rotation, and moreover, this can reduce the risk of accumulation of foreign matter in the crank chamber and abnormal wear of sliding portions inside the compressor.

MODE FOR CARRYING OUT THE INVENTION

An embodiment of the present invention will be hereinafter described in details with reference to the accompanying drawings.

Figure 1:
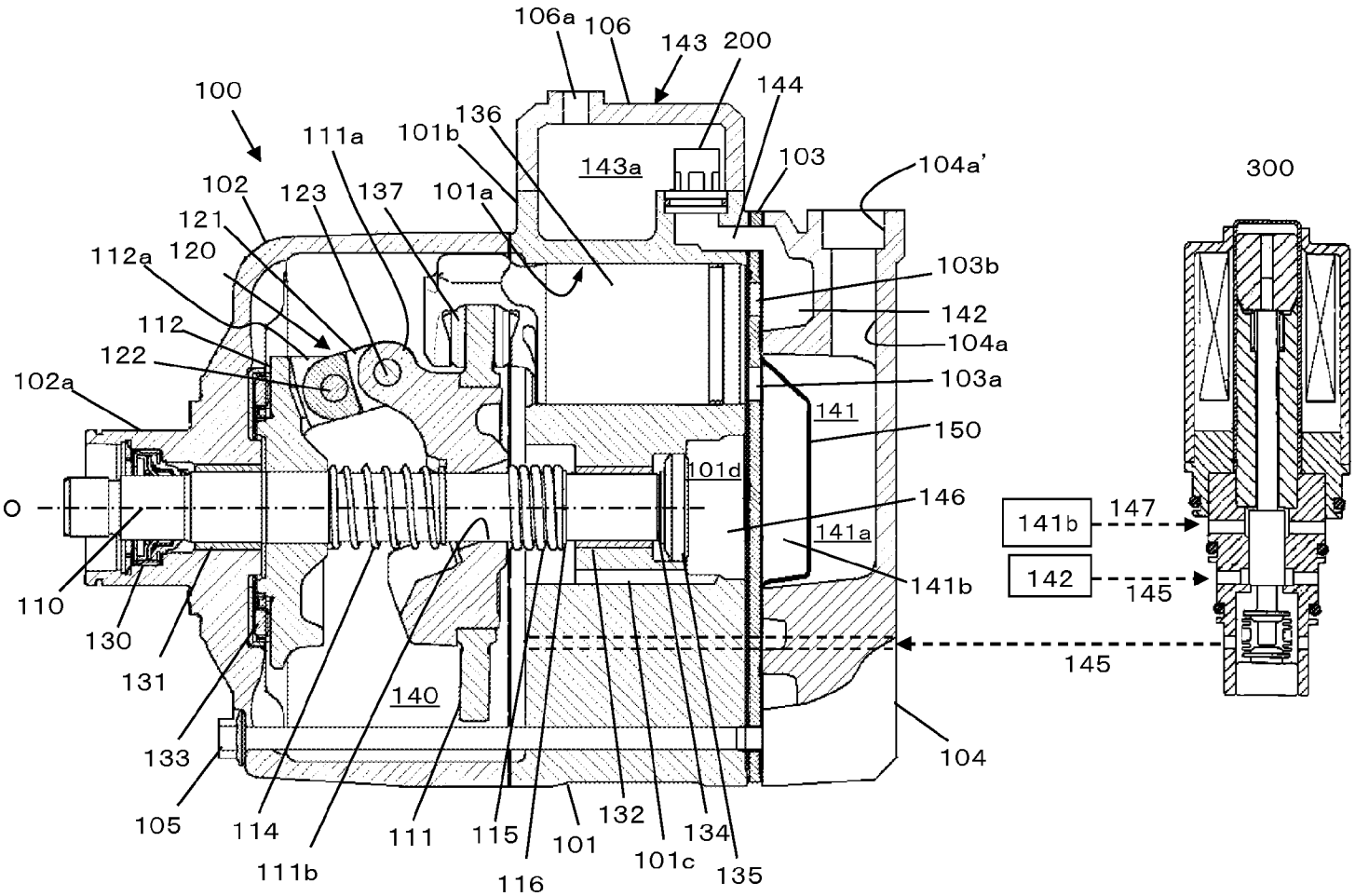
FIG. 1 is a cross sectional view illustrating a compressor according to an embodiment of the present invention.

FIG. 1 is a cross sectional view illustrating a swash plate-type variable displacement compressor 100, which is an example of a compressor to which the present invention is applied. This variable displacement compressor 100 is connected to a refrigerant circuit (evaporator and condenser), not shown, and in the variable displacement compressor 100, a piston 136 is caused to reciprocate, to compress refrigerant gas drawn from the refrigerant circuit and discharge the compressed refrigerant gas. In the present embodiment, the variable displacement compressor 100 is considered to be used for a vehicle air conditioner system.

As illustrated in FIG. 1, the variable displacement compressor 100 includes a cylinder block 101 having multiple cylinder bores 101*a* of the piston 136 formed therein, a front housing 102 provided at one end of the cylinder block 101, and a cylinder head 104 provided at the other end of the cylinder block 101 with a valve plate 103 and the like interposed therebetween.

A crank chamber 140 at the back of the piston 136 is formed by the cylinder block 101 and the front housing 102, and a drive shaft 110 is provided to cross the inside of this crank chamber 140 and is supported to be able to rotate.

A swash plate 111 is disposed around a middle portion of the drive shaft 110 in the axial direction. A through hole 111*b* is formed in a central portion of the swash plate 111, and the drive shaft 110 is inserted through the through hole 111*b*. The swash plate 111 is coupled with a rotor 112, fixed to the drive shaft 110 and rotating integrally with the drive shaft 110, via a linkage 120. With this linkage 120, the swash plate 111 rotates together with the drive shaft 110 and the rotor 112, and the inclination angle of the swash plate 111 can be changed with respect to the axis of the drive shaft 110.

The linkage 120 includes a first arm 112*a* provided to be in a protruding manner on the rotor 112, a second arm 111*a* provided to be in a protruding manner on the swash plate 111, and a link arm 121, one end of which is rotatably coupled to the first arm 112*a* via a first connection pin 122, and the other end of which is rotatably coupled to the second arm 111*a* via a second connection pin 123.

The through hole 111*b* of the swash plate 111 is formed in such a shape that the swash plate 111 can incline within a range from the maximum inclination angle to the minimum inclination angle. In the present embodiment, the through hole 111*b* is formed with a minimum inclination angle limitation unit for limiting the inclination angle displacement (inclining motion) of the swash plate 111 in a direction to reduce the inclination angle by coming into contact with the drive shaft 110. For example, where the inclination angle of the swash plate 111 is zero degrees (minimum inclination angle) when the swash plate 111 is perpendicular to the drive shaft 110, the minimum inclination angle limitation unit is formed to allow the inclination angle displacement (inclining motion) until the inclination angle of the swash plate 111 becomes substantially zero degrees. On the other hand, the inclination angle displacement (inclining motion) of the swash plate 111 in a direction to increase the inclination angle is limited when the swash plate 111 comes into contact with the rotor 112. Therefore, the inclination angle of the swash plate 111 becomes the maximum inclination angle when the swash plate 111 comes into contact with the rotor 112.

The drive shaft 110 is attached with a disinclining spring 114 for biasing the swash plate 111 in a direction to decrease the inclination angle and an inclining spring 115 for biasing the swash plate 111 in a direction to increase the inclination angle in such a manner that the swash plate 111 is interposed between the disinclining spring 114 and the inclining spring 115. More specifically, the disinclining spring 114 is attached between the swash plate 111 and the rotor 112, and the inclining spring 115 is attached between the swash plate 111 and a spring support member 116 provided on the drive shaft 110.

In this case, when the inclination angle of the swash plate 111 is the minimum inclination angle, the biasing force of the inclining spring 115 is configured to be greater than the biasing force of the disinclining spring 114. For this reason, when the drive shaft 110 is not rotating, i.e., the variable displacement compressor 100 is at a stop, the swash plate 111 is at the position of an inclination angle (>minimum inclination angle) at which the biasing force of the disinclining spring 114 and the biasing force of the inclining spring 115 are balanced.

One end of the drive shaft 110 penetrates through a boss portion 102*a* of the front housing 102 and extends to the outside of the front housing 102, and is coupled with a driving force transmission device (not shown). It should be noted that a shaft seal device 130 is inserted between the drive shaft 110 and the boss portion 102*a*, to form a seal between the inside of the crank chamber 140 and the outside.

The drive shaft 110 is supported by radial bearings 131,132 in the radial direction, and is supported by a thrust plate 134 in the thrust direction. It should be noted that the thrust plate 134 and the end portion of the drive shaft 110 at the side of the thrust plate 134 are adjusted to have a predetermined gap using an adjusting screw 135. Thus, the driving force from the external driving source (not shown), is transmitted to the driving force transmission device, so that the drive shaft 110 rotates in synchronization with the driving force transmission device.

The rotor 112 is supported by the drive shaft 110 in the radial direction, and is supported by the thrust bearing 133 in the thrust direction.

The piston 136 is disposed in the cylinder bore 101*a*, and an outer peripheral portion of the swash plate 111 is accommodated in the inner side space of the end portion of the piston 136 protruding toward the crank chamber 140, and the swash plate 111 is in synchronization with the piston 136 via a pair of shoes 137. With the shoes 137, the rotational motion of the swash plate 111 is converted into the reciprocating motion of the piston 136, and the piston 136 reciprocates in the cylinder bore 101*a*.

In the cylinder head 104, a suction chamber 141 disposed on an extension line of an axis O of the drive shaft 110 and a discharge chamber 142 disposed to enclose the suction chamber 141 in a ring manner, are divided therefrom and formed. The suction chamber 141 is in communication with each cylinder bore 101*a* via a suction hole 103*a* formed in the valve plate 103 interposed between the cylinder block 101 and the cylinder head 104, and via a suction valve (not shown) formed on a suction valve formation body. The discharge chamber 142 is in communication with a corresponding cylinder bore 101*a* via a discharge valve 138*a* formed on the discharge valve formation body 138 and a discharge hole 103*b* formed in the valve plate 103. The suction chamber 141 and the discharge chamber 142 are separated by a partition wall 104*b* (see FIG. 4, FIG. 6 and FIG. 8, described later). The partition wall 104*b* is formed substantially in a circular ring shape about the center of the axis O of the drive shaft 110, and the entire suction chamber 141 is substantially in a circular shape.

Figure 2:
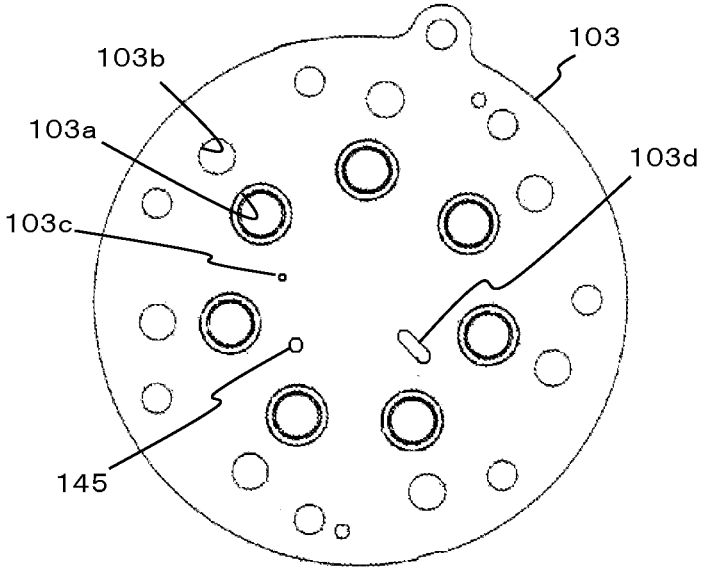
FIG. 2 is a top plan view illustrating a valve plate according to the present embodiment.
Figure 3:
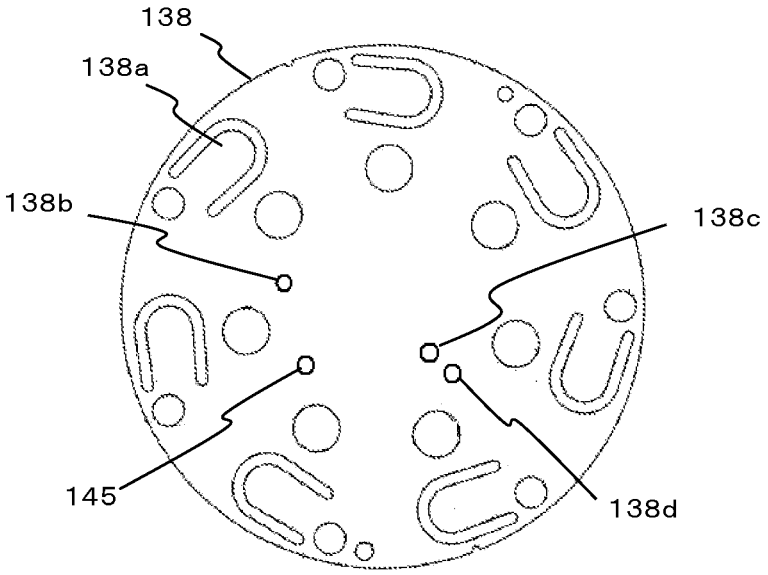
FIG. 3 is a top plan view illustrating a discharge valve formation body illustrated in FIG. 1.
Figure 4:
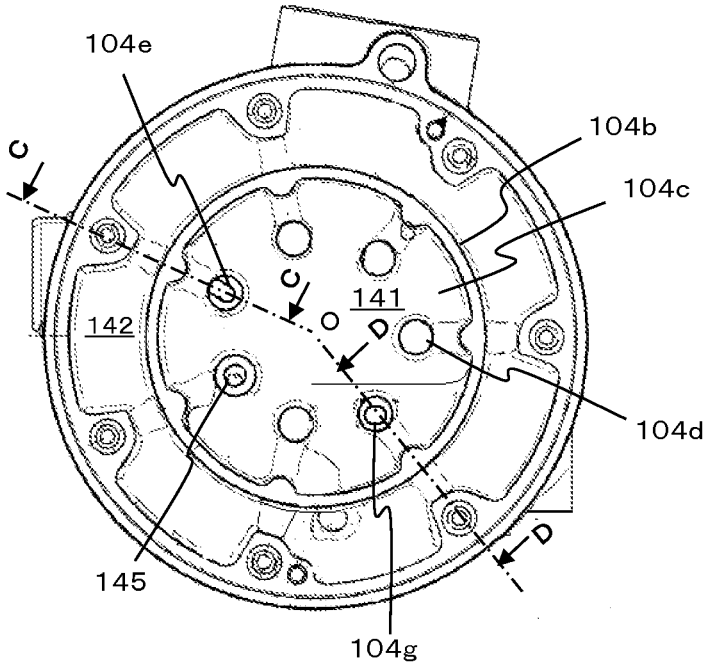
FIG. 4 is a top plan view illustrating a cylinder head according to the present embodiment.
Figure 5:
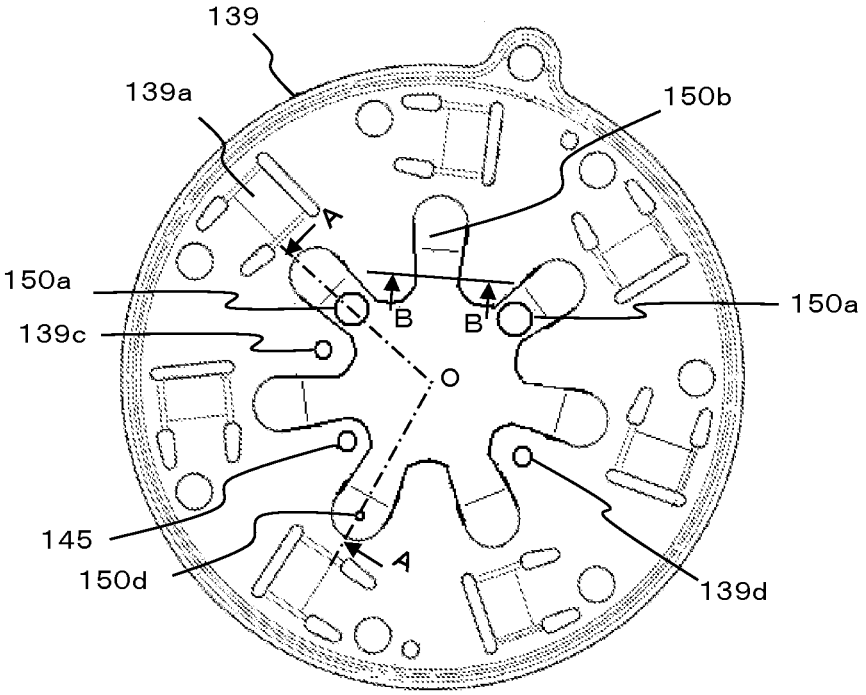
FIG. 5 is a top plan view illustrating a head gasket and a partition member according to the present embodiment.

In this case, the front housing 102, the center gasket (not shown) cylinder block 101, the cylinder gasket (not shown), the suction valve formation body (not shown), the valve plate 103, the discharge valve formation body 138, the head gasket 139, and the cylinder head 104 are fastened with multiple through bolts 105, to form a housing. FIG. 2 illustrates the valve plate 103, FIG. 3 illustrates the discharge valve formation body 138, FIG. 4 illustrates the cylinder head 104, and FIG. 5 illustrates the head gasket 139.

The cylinder head 104 is formed with a suction passage 104*a* having a connection port 104*a*', and this connection port 104*a*' is connected to a suction-side refrigerant circuit (evaporator) of the vehicle air conditioner system described above. Therefore, the refrigerant gas flows from the suction passage 104*a* into the suction chamber 141. The suction passage 104*a* is provided to linearly extend from the outer periphery of the cylinder head 104 toward the suction chamber 141, crossing a portion of the discharge chamber 142.

The suction chamber 141 is divided by a partition member 150 into a first space 141*a* connected with the suction passage 104*a* and a second space 141*b* connected with the suction hole 103*a*. In the present embodiment, the partition member 150 is provided with a communication hole 150*a* that allows the first space 141*a* and the second space 141*b* to be in communication with each other, and that serves as a communication passage for introducing the refrigerant gas, from which the lubricating oil has been separated, from the first space 141*a* into the second space 141*b*. The partition member 150 and the communication hole 150*a* will be described later in detail.

As illustrated in FIG. 1, at the outside of the cylinder block 101, a muffler 143 is provided. The muffler 143 is formed by coupling a tubular lid member 106 with a bottom with a tubular wall 101*b* disposed perpendicularly on the outer surface of the cylinder block 101 with a seal member (not shown) interposed therebetween. The lid member 106 is formed with a discharge port 106*a*, and this discharge port 106*a* is connected to a discharge-side refrigerant circuit (condenser) of the vehicle air conditioner system. A communication passage 144 for allowing the discharge chamber 142 and a muffler space 143*a* in the muffler 143 to be in communication with each other is formed to extend through the cylinder block 101, the valve plate 103, and the cylinder head 104. The muffler space 143*a*and the communication passage 144 form a discharge passage for allowing communication between the discharge chamber 142 and the discharge port 106*a*, and the muffler 143 forms the muffler space 143*a* along the discharge passage.

A check valve 200 for opening and closing an inlet of the muffler 143 is disposed in the muffler 143. The check valve 200 is disposed at a connection portion between the communication passage 144 and the muffler space 143*a*, and operates in response to a pressure difference between the communication passage 144 (upstream side) and the muffler space 143*a* (downstream side), and for example, when a difference (pressure difference) between the pressure in the communication passage 144 (upstream-side pressure) Pu and the pressure in the muffler space 143*a* (downstream-side pressure) Pd is greater than a predetermined value SL (Pu−Pd>SL>0), the check valve 200 opens, and when the pressure difference is equal to or less than the predetermined value SL, the check valve 200 closes.

The cylinder head 104 is further provided with a control valve 300.

The control valve 300 adjusts the degree of opening of a pressure supply passage 145 that allows communication between the discharge chamber 142 and the crank chamber 140, thus controlling the amount of introduction of the discharge gas to the crank chamber 140.

The refrigerant gas in the crank chamber 140 flows via a pressure releasing passage 146 (described later in detail) to the suction chamber 141 (first space 141*a*).

Therefore, the control valve 300 adjusts the amount of the discharge refrigerant introduced into the crank chamber 140 to change the pressure in the crank chamber 140, thus changing the inclination angle of the swash plate 111, i.e., the stroke of the piston 136, so that the capacity of the discharge of the variable displacement compressor 100 can be variably controlled.

More specifically, the control valve 300 adjusts the amount of electricity passed to a solenoid provided therein on the basis of an external signal, and variably controls the discharge capacity so that the pressure of the suction chamber 141 (second space 141*b*) introduced into a pressure sensing chamber of the control valve 300 via the pressure introducing passage 147 (described later in details) reaches a predetermined value. Alternatively, the control valve 300 cuts off electricity passed to the solenoid, and the control valve 300 forcibly opens the pressure supply passage 145 to perform control to make the discharge capacity of the variable displacement compressor 100 the minimum.

Hereinafter, in particularly, the partition member 150, the communication hole 150*a*, and the pressure releasing passage 146, which relate to the structure for reducing the OCR, will be described in detail with reference to FIGS. 2 to 8.

Figure 6:
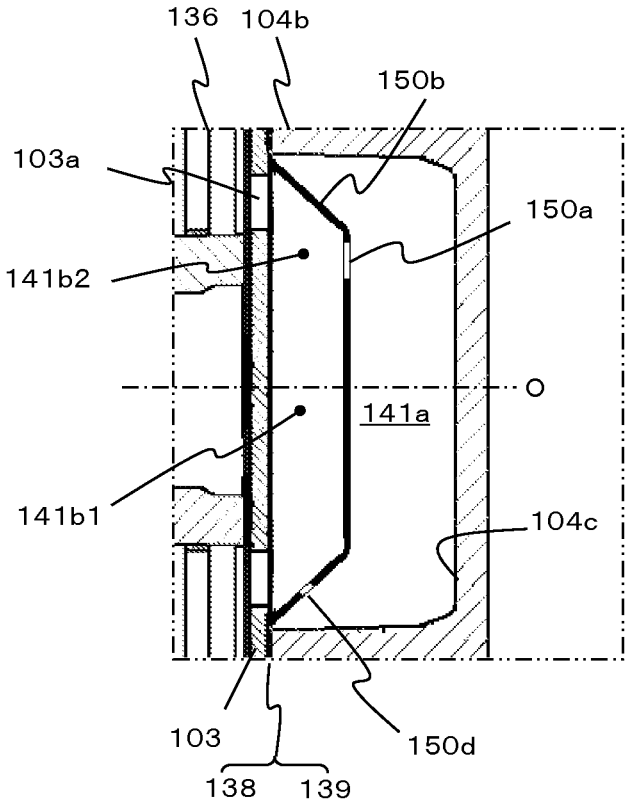
FIG. 6 is a partial cross sectional view taken along with a line A-O-A of FIG. 5.
Figure 7:
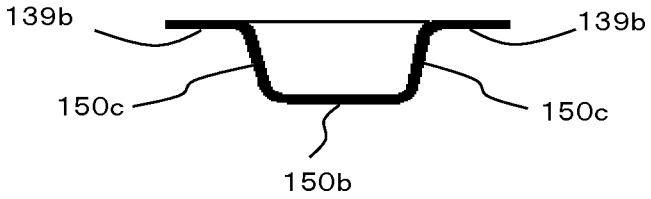
FIG. 7 is a partial cross sectional view taken along with a line B-B of FIG. 5.

As described above, the partition member 150 divides the suction chamber 141 into the first space 141*a* connected with the suction passage 104*a* and the second space 141*b* connected with the suction hole 103*a*. In this manner, the suction chamber 141 is divided into the second space 141*b* directly connected to the suction hole 103*a* and the first space 141*a* that is a space at the upstream side of the second space. As described later, the partition member 150 is formed such that the head gasket 139 is caused to protrude, and as illustrated in FIGS. 5 and 6, the second space 141*b* includes a central space 141*b*1 and a guiding passage 141*b*2 provided to extend from the central space 141*b*1 to each suction hole 103*a* in a radial manner and guiding the suction refrigerant gas. As illustrated in FIG. 7, the guiding passage 141*b*2 is formed with a bottom wall 150*b* and side walls 150*c*, and as illustrated in FIG. 6, the bottom wall 150*b* is formed with an inclination wall portion so that the size of the passage in cross section decreases toward the suction hole 103*a*.

The communication hole 150*a* formed in the partition member 150 is formed at a position at the upper side in the gravity direction of the first space 141*a*, for example, the upper side in the gravity direction with respect to the axis O of the drive shaft 110 (the upper side in FIGS. 1 to 5 is the upper side in the gravity direction) so as to allow the first space 141*a* and the second space 141*b* to be in communication with each other. It should be noted that the communication hole 150*a* is open at a position away from an area on an extension of the suction passage 104*a* into the suction chamber 141, so that the mainstream of the refrigerant gas flowing from the suction passage 104*a* to the first space 141*a* does not directly flow into the second space 141*b* at the downstream side.

In this case, the second space 141*b* directly connects to the suction hole 103*a*, and is separated from the suction passage by the partition member 150. Therefore, the second space 141*b* is substantially a suction chamber, and the first space 141*a* directly connected to the suction passage can be deemed as a portion of the suction passage, and the communication hole 150*a* is substantially an outlet of the suction passage. For example, the communication hole 150*a* is formed at the upper side in the gravity direction with respect to the axis O of the drive shaft 110 so as to allow the first space 141*a* and the second space 141*b* to be in communication, so that the first space 141*a* serves as an oil storage chamber for storing the lubricating oil flowing back from the vehicle air conditioner system together with the suction refrigerant gas. In this manner, the communication hole 150*a* allows communication between the first space 141*a* and the second space 141*b*, introduces the refrigerant gas, from which the lubricating oil has been separated, from the first space 141*a* to the second space 141*b*.

Multiple protruding units 104*d* for pressing, toward the valve plate, the peripheral edge portion of the partition member of the head gasket 139 are formed in a protruding manner on the suction chamber forming wall surface of the cylinder head 104 facing the valve plate 103. More specifically, the protruding unit 104*d* extends from the bottom wall 104*c* of the cylinder head 104 (suction chamber forming wall surface) so as to press the areas between adjacent guiding passages 141*b*2, and the protruding unit 104*d* presses the valve plate 103 via the head gasket 139 and the discharge valve formation body 138. The protruding units 104*d* are annularly arranged at regular intervals around the center of the cylinder head 104 (see FIG. 4). The suction holes 103*a* (see FIG. 2 and the like) formed in the valve plate 103 are at the same distance from the axis O of the drive shaft 110, and are annularly arranged at regular intervals around the axis of the drive shaft 110.

For example, the partition member 150 is formed such that the portion facing the suction chamber 141 of the head gasket 139 protrudes into the suction chamber. More specifically, the area of the head gasket 139 corresponding to the suction chamber 141 is caused to protrude, and thus, the partition member 150 is formed by using the head gasket 139. Therefore, it is not necessary to add an additional component as the partition member 150, and in addition, it is not necessary to separately add a structure for fixing the partition member 150 into the suction chamber 141. Therefore, this can prevent an increase in cost caused by providing the partition member 150. The head gasket 139 is made by coating a thin plate of metal with rubber, and the partition member 150 is pressed integrally with the head gasket 139 and has rubber coating applied thereto. The head gasket 139 is formed with a retainer 139*a* for limiting the degree of opening of the discharge valve 138*a*, in the area corresponding to the discharge chamber 142 at the outside in the diameter direction.

On both sides of the side wall 150*c* at the forming portion of the guiding passage 141*b*2 of the partition member 150, a flat portion 139*b* of the head gasket 139 is provided. The protruding unit 104*d* presses the flat portion 139*b*, so that the partition member 150 can be reliably held on the valve plate 103.

For example, out of the guiding passages 141*b*2, a guiding passage 141*b*2 disposed at the lower side in the gravity direction with respect to the axis O of the drive shaft 110 has the bottom wall 150*b* provided with a small hole 150*d* that allows communication between the first space 141*a* and the guiding passage 141*b*2 (more specifically, second space 141*b*) (see FIGS. 5 and 6). It should be noted that the small hole 150*d* is configured to have the size of area of the aperture and the height from the bottom of the first space 141*a* serving as the storage chamber so as to store an appropriate amount of oil in the first space 141*a*.

Figure 8:
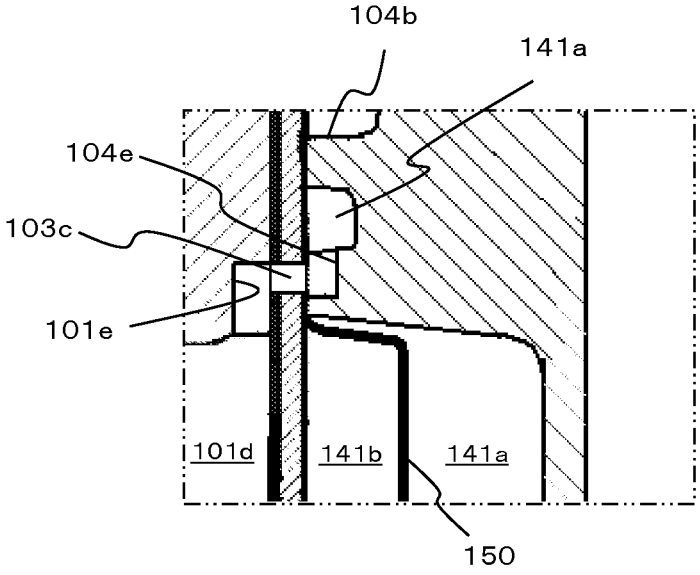
FIG. 8 is a partial cross sectional view taken along with a line C-C of FIG. 4.

The pressure releasing passage 146 allows the first space 141*a* and the crank chamber 140 provided at the back of the piston 136 to be in communication with each other and configured to discharge the pressure in the crank chamber, and includes, for example, a communication passage 101*c* formed to be in parallel with the drive shaft 110 in the cylinder block 101 (see FIG. 1), a space 101*d* formed at the side of the end portion of the drive shaft 110 (see FIGS. 1 and 8), a communication passage 101*e* formed at an end surface of the cylinder block 101 at the side of the cylinder head 104 (see FIG. 8), a communication hole (not shown) formed on each of the cylinder gasket and the suction valve formation body, an orifice 103*c* formed in the valve plate 103 (see FIGS. 2 and 8), a communication hole 138*b* formed in the valve formation body 138 (see FIG. 3), a communication hole 139*c* formed in the head gasket 139 (see FIG. 5), and a groove 104*e* formed on an end surface of the protruding unit 104*d* and in communication with the first space 141*a* (see FIG. 8). Therefore, the refrigerant gas including the lubricating oil in the crank chamber 140 flows via the pressure releasing passage 146 into the first space 141*a*.

The pressure releasing passage 146 is connected to the first space 141*a* at the upper side in the gravity direction of the first space 141*a*, for example, at the upper side in the gravity direction with respect to the axis O of the drive shaft 110. More specifically, the groove 104*e* of the pressure releasing passage 146 is connected to the first space 141*a* at the upper side in the gravity direction with respect to the axis O of the drive shaft 110, and as illustrated in FIG. 4, this groove 104*e* extends toward the partition wall 104*b*.

Subsequently, the action of the variable displacement compressor 100 having the above configuration will be described with reference to FIGS. 6 to 8.

The refrigerant gas flowing from the suction passage 104*a* into the first space 141*a* flows via the communication hole 150*a* to the second space 141*b*, and flows along the guiding passage 141*b*2 to each suction hole 103*a*. In this case, when the lubricating oil from the air conditioner system flows back together with the refrigerant gas from the suction passage 104*a*, this lubricating oil stays at the bottom of the first space 141*a* serving as the storage chamber due to its own weight, and is separated from the refrigerant gas. Then, the refrigerant gas from which the lubricating oil that has been separated is introduced through the communication hole 150*a* from the first space 141*a* to the second space 141*b*, and the refrigerant gas in the second space 141*b* is introduced into the cylinder bore 101*a* via the suction hole 103*a*, and then, the refrigerant gas is compressed by the piston 136 and is discharged, so that this reduces the amount of lubricating oil flowing out from the variable displacement compressor 100 to the vehicle air conditioner system. On the other hand, when the lubricating oil stored in the crank chamber 140 flows via the pressure releasing passage 146 from the crank chamber 140 to the first space 141*a*, this lubricating oil likewise stays in the first space 141*a* due to its own weight, and is separated from the refrigerant gas. Even in this case, the refrigerant gas from which the lubricating oil has been separated is introduced through the communication hole 150*a* into the second space 141*b*, and this prevents the lubricating oil from flowing to the second space 141*b* and further to the external refrigerant circuit. In this case, when the oil height of the lubricating oil held in the first space 141*a* exceeds the height of the small hole 150*d*, the lubricating oil flows back from the first space 141*a* to the second space 141*b*, so that this contributes to lubrication of each unit of the variable displacement compressor 100.

As described above, according to the variable displacement compressor 100 of the present embodiment, the partition member 150 divides the suction chamber 141 into the first space 141*a* and the second space 141*b*, and the suction passage 104*a* is connected to the first space 141*a*, and the suction hole 103*a* is connected to the second space 141*b*, and the refrigerant gas from which the lubricating oil has been separated is introduced from the first space 141*a* to the second space 141*b* directly connected to the suction hole 103*a* via the communication passage 150*a*. Therefore, even when the lubricating oil flows back together with the refrigerant gas from the air conditioner system and flows into the suction chamber 141, the refrigerant gas from which the lubricating oil has been separated can be compressed and discharged.

Since the pressure releasing passage 146 is connected to the first space 141*a*, which is on the upstream side of the second space 141*b*, even if the lubricating oil flows out together with the refrigerant gas from the crank chamber 140 to the suction chamber 141 via the pressure releasing passage 146, the refrigerant gas from which the lubricating oil has been separated is introduced from the first space to the second space via the communication passage. Therefore, the refrigerant gas from which the lubricating oil has been separated can be compressed and discharged.

As described above, the lubricating oil can be separated by using the first space 141*a* which is a part of the suction chamber 141. Therefore, with the simple structure, the lubricating oil flowing out to the external refrigerant circuit can be prevented, and the OCR can be reduced.

In addition, since the lubricating oil flowing out from the crank chamber is separated and stored in the first space, no excessive lubricating oil remains in the crank chamber, and this can reduce a decrease in oil viscosity during high speed rotation, and moreover, this can reduce the risk of accumulation of foreign matter in the crank chamber and abnormal wear of sliding portions inside the compressor. In the first space 141*a*, a high temperature lubricating oil flowing out from the crank chamber 140 can be cooled by the refrigerant gas drawn thereinto from the suction passage 104*a*, and this can reliably prevent the decrease in viscosity of the lubricating oil.

Furthermore, the first space 141*a* not only stores the lubricating oil but also functions as a liquid storage space for liquid refrigerant returning from the vehicle air conditioner system, thus reducing the risk of compressing the liquid refrigerant with the piston 136.

Since each suction hole 103*a* is partitioned by formation walls forming the guiding passage 141*b*2 (the bottom wall 150*b* and the side walls 150*c*), this can make the refrigerant gas smoothly flow toward each suction hole 103*a*. In addition, mutual interference of the suction refrigerant gas flowing to each suction hole 103*a* can be prevented. Therefore, the suction pressure pulsation level can be reduced.

Furthermore, since the pressure releasing passage 146 (groove 104*e*) is connected at the upper side in the gravity direction of the first space 141*a*, for example, at the upper side in the gravity direction with respect to the axis O of the drive shaft 110, when, for example, the liquid surface of the lubricating oil stored in the first space 141*a* is located at the lower side in the gravity direction with respect to the axis O of the drive shaft 110, the lubricating oil stored in the first space 141*a* is less likely to be agitated by the refrigerant gas flowing from the crank chamber 140 to the first space 141*a*, and this can prevent the stored oil from spattering and flowing out from the communication hole 150*a* to the second space 141*b*, and furthermore, this can prevent the oil from flowing out to the external refrigerant circuit, thus achieving greater reduction of the OCR.

Since the communication passage (communication hole 150*a*) that allows the first space 141*a* and the second space 141*b* to be in communication with each other is formed in the partition member 150, the position adjustment of the communication passage can be done at the same time as the position adjustment of the partition member 150, so that the position adjustment of the communication passage can be done easily. In FIG. 5, two communication holes 150*a* are formed, but there may be one communication hole 150*a*, or there may be three or more communication holes 150*a*. FIG. 6 shows a case in which the communication passage 150*a* that allows the first space 141*a* and the second space 141*b* to be in communication with each other is formed by simply penetrating through the partition member 150, but the embodiment is not limited thereto. Alternatively, a tubular wall may be formed to protrude toward the first space 141*a*. In this case, the lubricating oil separation effect can be further improved at the first space 141*a*. The structure of improving the lubricating oil separation effect is not limited to the structure of forming the communication passage 150*a* with the tubular wall described above, but it may be of other structures. In the foregoing, the communication passage (communication hole 150*a*) that allows the first space 141*a* and the second space 141*b* to be in communication with each other is formed in the partition member 150, but the embodiment is not limited thereto. For example, a passage may be separately provided with a pipe and the like.

The contents of the present invention have been described in a specific manner with reference to preferable embodiments, but it is obvious to one skilled in the art that it is possible to employ various kinds of modified aspects on the basis of basic technical concepts and teachings of the present invention.

In the present embodiment, the partition member 150 is integrally formed with the head gasket 139, but the embodiment is not limited thereto. The partition member 150 may be formed separately from the head gasket 139.

In the foregoing, the pressure releasing passage 146 is connected to the first space 141*a* at the upper side in the gravity direction with respect to the axis O of the drive shaft 110, but the embodiment is not limited thereto. For example, the pressure releasing passage 146 may be connected to the first space 141*a* at the lower side in the gravity direction with respect to the axis O of the drive shaft 110, and the lubricating oil stored in the first space 141*a* when the rotation of the variable displacement compressor 100 is stopped may be returned to the side of the crank chamber 140.

The small hole 150*d* is formed to allow the first space 141*a* and the second space 141*b* to be in communication with each other, but the embodiment is not limited thereto. The small hole 150*d* may be formed to allow the first space 141*a* and the crank chamber 140 to be in communication with each other. In this configuration, when the rotation of the variable displacement compressor 100 is stopped, the lubricating oil stored in the first space 141*a* can be returned to the crank chamber 140.

The compressor 100 may not only be a swash plate-type variable displacement compressor but also a wobble plate-type variable displacement compressor. Furthermore, the invention of the present application can be applied to various kinds of known compressors such as a variable displacement compressor having an electromagnetic clutch, a clutch-less compressor having no electromagnetic clutch, a fixed-capacity type reciprocal compressor, a reciprocal compressor driven by a motor, and the like.

REFERENCE SYMBOL LIST

100 Compressor (variable displacement compressor)
103 Valve plate
103*a* Suction hole
104 Cylinder head
104*a* Suction passage
104*d* Protruding unit
136 Piston
139 Head gasket
140 Crank chamber
141 Suction chamber
141*a* First space
141*b* Second space
146 Pressure releasing passage
150 Partition member
150*a* Communication passage (communication hole)

The invention claimed is:

1. A compressor in which a piston is caused to reciprocate, so that a refrigerant gas drawn from a suction chamber via a suction hole is compressed and discharged, the compressor comprising:

a partition member that divides the suction chamber, into which the refrigerant gas flows from a suction passage, into a first space for separating lubricating oil from the refrigerant gas, the first space being connected to the suction passage, and a second space connected to the suction hole; and a pressure releasing passage configured to allow the first space and a crank chamber provided at the back of the piston to be in communication with each other, and to discharge a pressure in the crank chamber, wherein, in the partition member, a communication passage configured to allow the first space and the second space to be in communication with each other, and introduce the refrigerant gas, from which the lubricating oil has been separated, from the first space to the second space, is formed, and a small hole configured to allow the first space and the second space to be in communication with each other, and allow the lubricating oil stored in the first space to return to the second space, is formed.

2. The compressor according to claim 1, wherein the pressure releasing passage is connected at an upper side in a gravity direction with respect to an axis of a drive shaft, and wherein the small hole is disposed at a lower side in the gravity direction with respect to the axis of the drive shaft.

3. The compressor according to claim 1, wherein the small hole is configured to have a size of an aperture area and a height from the bottom of the first space so as to store a predetermined amount of the lubricating oil in the first space.

4. The compressor according to claim 1, wherein the partition member is formed such that a portion, facing the suction chamber, of a head gasket interposed between a valve plate having the suction hole formed therein and a cylinder head having the suction chamber formed therein, is caused to protrude into the suction chamber.

5. The compressor according to claim 4, wherein the suction chamber is configured to be disposed on an extension line of an axis of a drive shaft, and wherein a protruding unit for pressing, toward the valve plate, a peripheral edge portion of the partition member of the head gasket, is formed in a protruding manner on a suction chamber forming wall surface of the cylinder head facing the valve plate.

6. The compressor according to claim 4, wherein the suction chamber is configured to be disposed on an extension line of an axis of a drive shaft, and wherein the second space includes a central space, and a guiding passage provided to extend from the central space to the suction hole and guiding the refrigerant gas.

* * * * *